US006688199B2

(12) United States Patent
Godston et al.

(10) Patent No.: US 6,688,199 B2
(45) Date of Patent: Feb. 10, 2004

(54) FOUR-BAR UPRIGHT PUNCH

(75) Inventors: Jon Godston, Cusago (IT); Sumir Kapur, Oak Park, IL (US); Scott Kouri, Chicago, IL (US); Michael Albertini, Chicago, IL (US); John McClusky, Portland, OR (US); Paul R. Holbrook, Buffalo Grove, IL (US); Balaji Kandasamy, Naperville, IL (US); Andrew Kist, Palatine, IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/893,398

(22) Filed: Jun. 29, 2001

(65) Prior Publication Data

US 2002/0020272 A1 Feb. 21, 2002

Related U.S. Application Data

(60) Provisional application No. 60/215,768, filed on Jun. 30, 2000.

(51) Int. Cl.[7] ..... B26D 7/00

(52) U.S. Cl. ..... 83/167; 83/626; 83/670; 83/691

(58) Field of Search ..... 83/167, 166, 146, 83/147, 687, 620, 140, 691, 624, 625, 626, 327, 328

(56) References Cited

U.S. PATENT DOCUMENTS

| | | | | | |
|---|---|---|---|---|---|
| 383,200 | A | | 5/1888 | Weber et al. | |
| 3,735,655 | A | * | 5/1973 | Dedona et al. | 83/140 |
| 3,756,625 | A | | 9/1973 | Abilgaard et al. | |
| 3,793,660 | A | | 2/1974 | Sims | 11/1 AC |
| 3,826,168 | A | | 7/1974 | Groswith, III et al. | |
| 3,921,487 | A | * | 11/1975 | Otsuka et al. | 83/467 |
| 4,036,088 | A | * | 7/1977 | Ruskin | 83/167 |
| 4,077,288 | A | | 3/1978 | Holland | 83/146 |
| 4,499,805 | A | * | 2/1985 | Mori | |
| 4,656,907 | A | * | 4/1987 | Hymmen | 83/571 |
| 4,713,995 | A | | 12/1987 | Davi | |
| 4,833,958 | A | | 5/1989 | Abildgaard et al. | 83/154 |
| 5,007,782 | A | | 4/1991 | Groswith, III et al. | 412/40 |
| 5,040,441 | A | * | 8/1991 | Tamura | 83/166 |
| 5,143,502 | A | * | 9/1992 | Kaufmann et al. | 412/16 |
| 5,163,350 | A | | 11/1992 | Groswith, III et al. | 83/549 |
| 5,247,863 | A | * | 9/1993 | Cohen | 83/167 |
| 5,273,387 | A | | 12/1993 | Groswith, III et al. | 412/40 |
| 5,431,519 | A | | 7/1995 | Baumann | 412/40 |
| 5,664,473 | A | * | 9/1997 | Huang | 83/620 |
| 5,683,218 | A | | 11/1997 | Mori | 412/40 |
| 5,740,712 | A | | 4/1998 | Watkins et al. | 83/549 |

FOREIGN PATENT DOCUMENTS

| | | |
|---|---|---|
| EP | 0283676 A2 | 9/1988 |

* cited by examiner

*Primary Examiner*—Derris H. Banks
*Assistant Examiner*—Ali Abdelwahed
(74) *Attorney, Agent, or Firm*—Michael Best & Friedrich LLP

(57) ABSTRACT

The present invention relates to a punch for punching a workpiece. In particular, the invention relates to a punch including a base to stably support the punch and a support member configured to accommodate and locate the workpiece in a punching position. The support member is preferably movably connected to the base and preferably includes at least one punch member configured and operably associated with the support portion to punch the workpiece in the punching position upon an actuation movement of the support member with respect to the base. Another embodiment of the present invention relates to a punch having a paper tray oriented at an angle with respect to the base to support a sufficient portion of a sheet of paper to prevent an unsupported portion from falling over and withdrawing from the support portion. In particular, the paper tray and punch mechanism are oriented to expel paper chips such that the chips are visible to an operator as they are punched.

29 Claims, 13 Drawing Sheets

FOUR-BAR UPRIGHT PUNCH

RELATED APPLICATIONS

The present application claims priority to U.S. Provisional Application No. 60/215,768, filed Jun. 30, 2000, and entitled "Four Bar Upright Punch," which is incorporated herein in its entirety.

FIELD OF THE INVENTION

The present invention relates to an apparatus for performing a punching operation. More particularly, the invention relates to paper punches having a linkage to provide a mechanical advantage to facilitate manual punching of the workpiece.

BACKGROUND OF THE INVENTION

Punches to perform a punching operation, such as punching one or more holes in a stack of paper sheets, are typically configured to punch horizontally oriented sheets of paper with a vertically aligned punch mechanism. These require that an operator carefully ensure that the sheets are appropriately aligned with each other and the punch mechanism.

Typical punches that accommodate vertically oriented paper leave an upper portion of the paper unsupported, allowing the paper to buckle or fall over, which can move the paper out of alignment with respect to the punch mechanism. For example, U.S. Pat. No. 4,077,288 to Holland discloses a punch having a stripper plate and a die plate that form a guide for the vertical entry of a sheet to be punched.

Punches that employ a linkage to actuate the punch, include links generally aligned above a vertically oriented punch mechanism. For example, U.S. Pat. No. 5,007,782 to Groswith, III et al. discloses a punch having a four-bar linkage in which displaced portions of the paper are discarded beneath a horizontal die plate.

SUMMARY OF THE INVENTION

The present invention relates to a punch for punching a workpiece. The punch preferably includes a base to stably support the punch and a support member configured to accommodate and locate the workpiece in a punching position. The support member is preferably movably connected to the base and preferably includes at least one punch member configured and operably associated with the support member to punch the workpiece in the punching position upon actuation movement of the support portion with respect to the base. Work pieces suitable for punching with any of the punches of the invention include paper work pieces, such as one or more sheets of paper.

The punch preferably includes a kinematic linkage that includes the base and also a first member that includes the support member. Preferably, the linkage comprises at least four link members movable with respect to each other and connected together in a closed loop.

The support member is preferably pivotably connected to the base and the actuation movement is a pivoting motion with respect to the base. The punch preferably includes an actuating portion configured for manual operation and mechanically operatively connected to the support member and punch member for manually imparting the actuation movement. In a preferred embodiment, actuating portion is pivotable through an angle greater than about 60 degrees to actuate the punch.

In another preferred embodiment, the linkage includes at least four pivots defining there between a quadrilateral having at least two opposed, substantially non-parallel sides. The linkage preferably includes at least two opposed, substantially non-parallel sides that include first and second pairs of opposed, substantially non-parallel sides.

Another embodiment of the present invention relates to a punch for punching a workpiece. The punch preferably includes a four-bar linkage comprising at four members movable parallel to a first plane upon actuation of the linkage and a support member operably associated with the linkage and configured to accommodate and locate the workpiece. The punch includes at least two punch elements configured to punch at least two holes in the workpiece upon actuation of the linkage, wherein the at least two punch elements are movable within a second plane upon actuation of the linkage, wherein the second plane is disposed at an angle to the first plane.

In a preferred embodiment, the first plane is substantially perpendicular to the second plane. The linkage is preferably manually operable and preferably includes an manually actuating operable actuating member movable substantially parallel to the first plane. The support portion is preferably configured to receive the workpiece at an upright angle for punching.

Another embodiment of the present invention relates to a punch for punching at least one sheet of paper. The punch includes a base and a support portion having a paper tray oriented an angle with respect to the base to punchably support a sufficient portion of the sheet of paper to prevent an unsupported portion of the paper from falling over and withdrawing from the support portion. The punch preferably includes at least one punch mechanism operably associated with the support portion to punch at least one hole in the supported sheet upon actuation of the punch.

In a preferred embodiment, the paper tray and punch mechanism are oriented to expel paper chips from the punch in a direction at a non-zero angle with respect to the horizontal. Preferably, the punch element, such as a punch pin of the punch mechanism, travels along a punch axis that is disposed at a non-zero angle with respect to the horizontal. Preferably, the axis is at least about 0.5° and more preferably, at least about 3° to the horizontal. The expelled chips are visible to an operator as they are punched. Preferably, the punch also includes a container associated with the punch mechanism and configured to receive a portion of the paper chips, wherein the container is sufficiently transparent to allow the paper chips to be viewed therethrough.

The support surface is preferably oriented at an angle from the vertical to allow gravity to assist positioning the first surface of the sheet of paper against the support portion. At least a portion of the support portion is concave along a horizontal direction.

The punch preferably includes an at least four-member linkage operably associated with the punch mechanism and support portion such that actuation of the linkage actuates the punch. In a preferred embodiment, the linkage comprises an actuating portion manually operable to acuate the linkage.

Another embodiment of the present invention relates to a punch for punching at least one sheet of paper, including a base, a support portion comprising an arcuate portion configured to support a first surface of the sheet of paper in an arcuate punching position, and at least one punch mechanism operably associated with the support portion to punch at least one hole in the supported sheet upon actuation of the punch.

The support portion is preferably oriented upright to allow gravity to assist positioning the paper against the support surface. More preferably the support portion is oriented at an angle to the vertical and more than one-third of the support portion is arcuate.

Another embodiment of the invention relates to a punch for punching holes in a workpiece, comprising a linkage comprising at least one member, a support member operably associated with the linkage and configured to accommodate the workpiece, at least one punch mechanism operably associated with the support member and linkage to punch a hole substantially adjacent a first edge of the workpiece upon actuation of the linkage. By substantially adjacent the first edge it is meant a distance suitable to allow the punched workpiece to be secured within a binding mechanism, such as a ring binder. Preferably, the member moves within a plane that is transverse to the first edge of the workpiece. In a preferred embodiment, the plane is substantially perpendicular to the first edge of the workpiece. The linkage is preferably a four bar linkage comprising four members. Each of the four members preferably move in a respective plane transverse to the first edge.

Another embodiment of the invention relates to a punch for punching holes in at least one sheet of paper, comprising a base, a support portion oriented upright with respect to the base to punchably support a sufficient portion of the sheet of paper to prevent an unsupported portion of the paper from falling over, at least one punch mechanism operably associated with the support portion to punch at least one hole in the supported sheet upon actuation of the punch.

Preferably, the support surface is oriented at an angle from the vertical to allow gravity to assist positioning the first surface of the sheet of paper against the support portion.

Another embodiment of the invention relates to a punch for punching holes in a workpiece comprising a four bar linkage and an at least one punch element operably associated with a first member of the linkage where upon actuation of the linkage, an arcuate motion of the first member operates the punch to punch a whole in the workpiece. Preferably the linkage comprises at least four members.

In the preferred embodiment, the first member of the linkage abuts the at least one punch element upon actuation of the linkage. The embodiment preferably includes a second member of the linkage that is configured to stably support the punch. The punch preferably comprises a support member to accommodate and locate the workpiece in an upright punching position. In the preferred embodiment, the linkage is actuated upon an arcuate motion of a third member of the linkage, the first and third being pivotably associated.

DETAILED DESCRIPTION OF THE PREFERRED EMBODIMENTS

Figure 1:
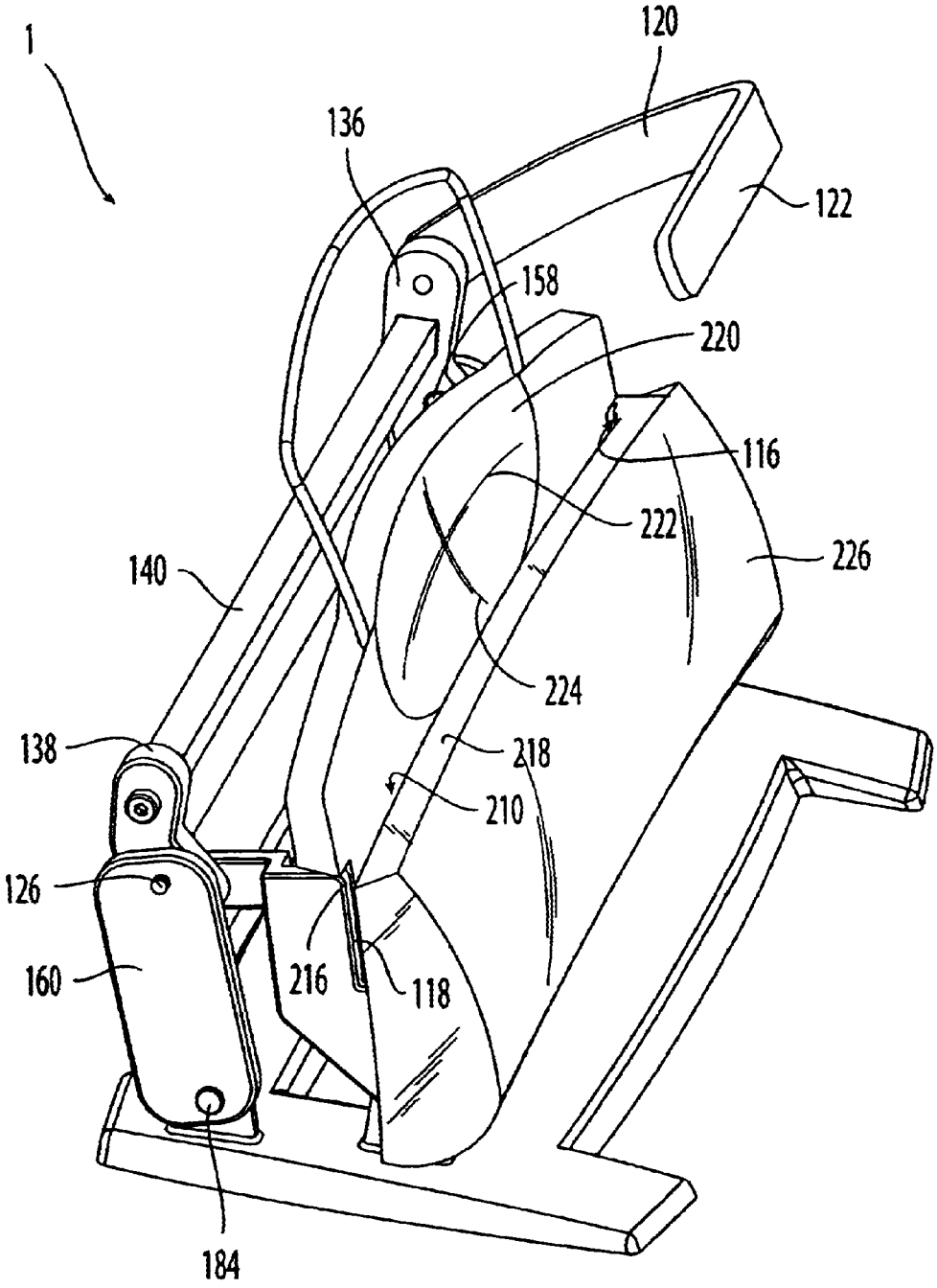
FIG. 1 is a perspective view of a punch constructed according to the invention in a ready position.
Figure 2:
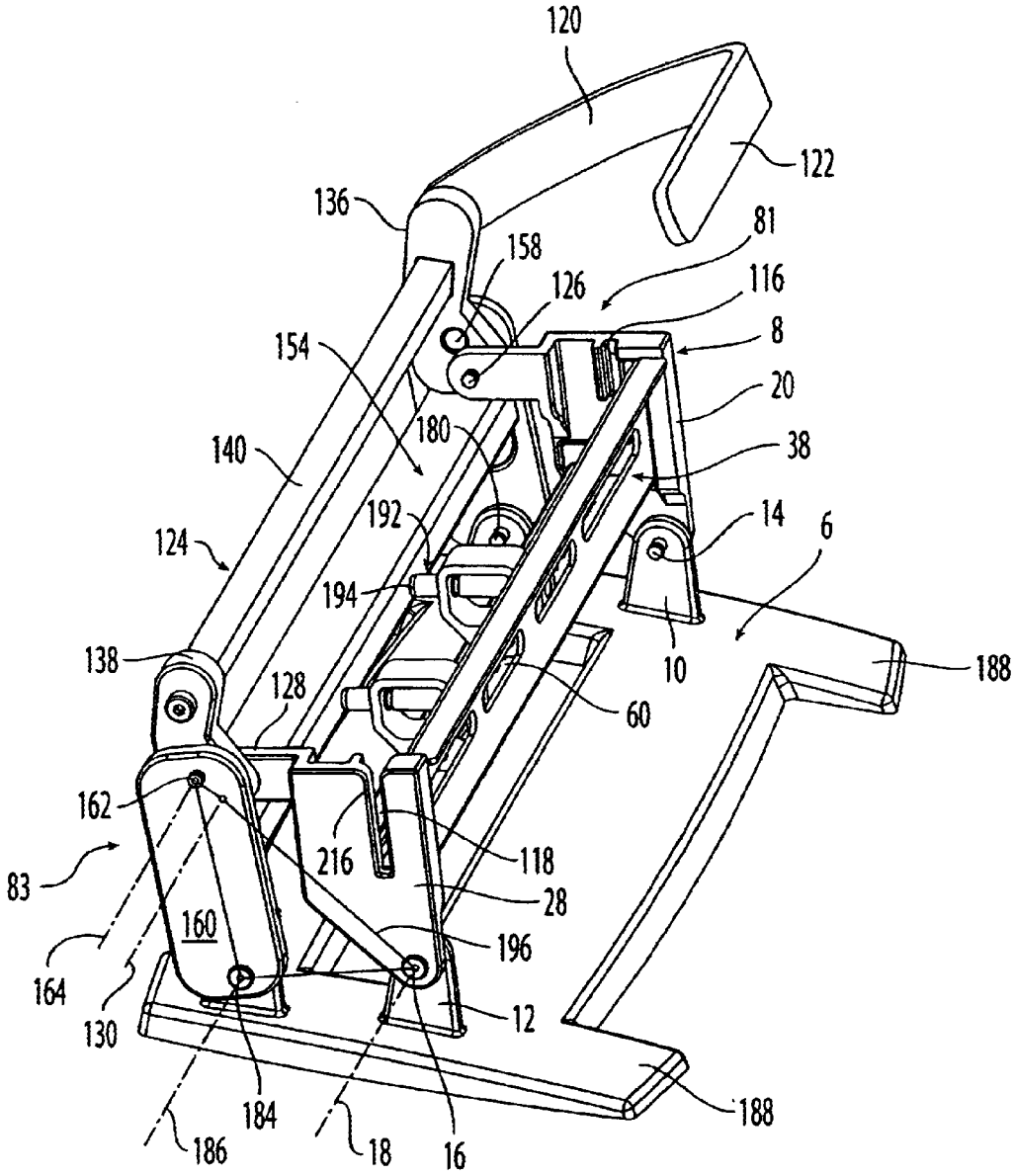
FIG. 2 is a perspective view of the punch of the invention shown in the ready position with a support portion and a receiving portion removed.
Figure 3:
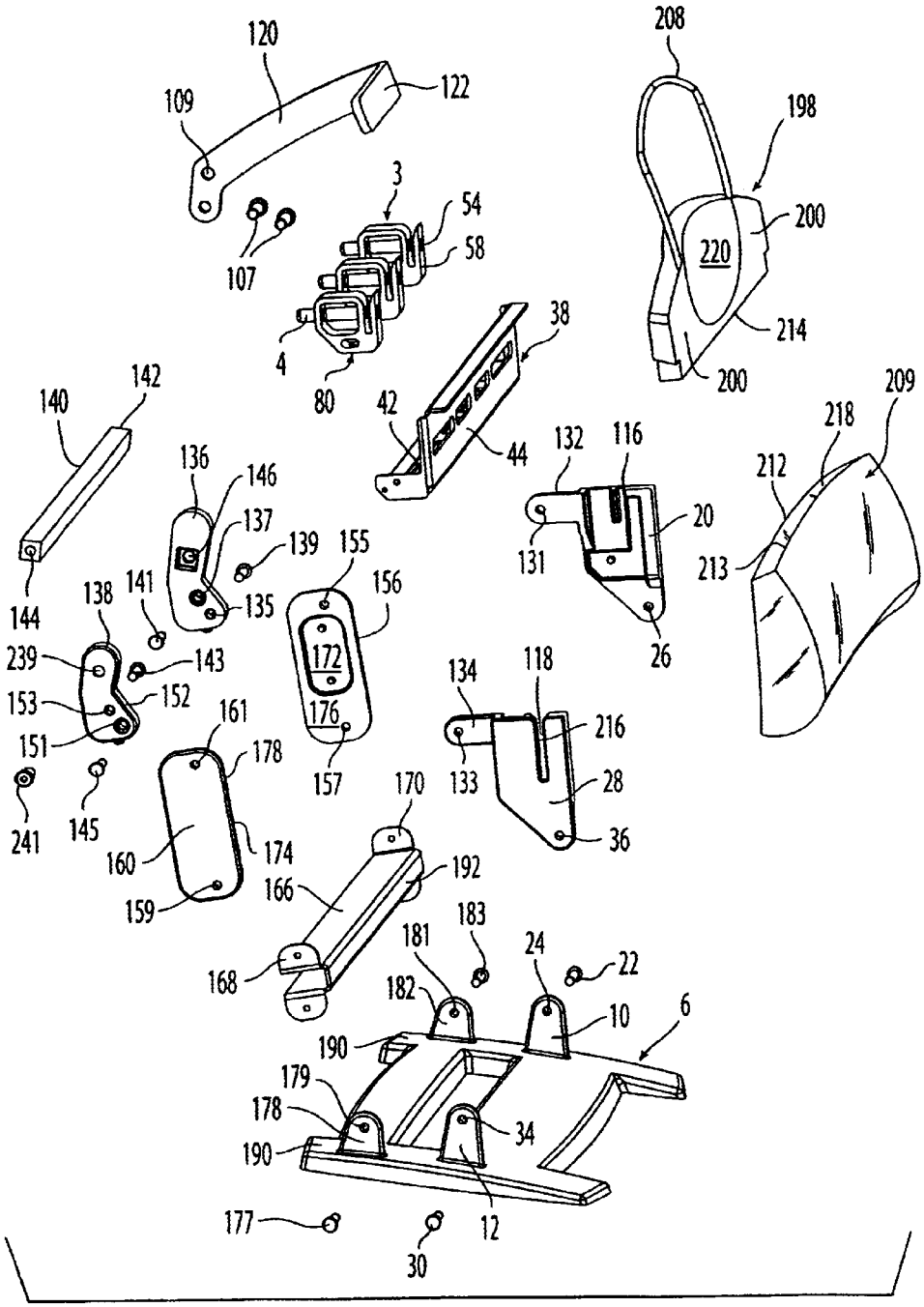
FIG. 3 is an exploded view of the punch.

Referring to FIGS. 1–3, punch 1 is preferably configured to perform a punching operation on a workpiece, such as displacing, preferably by shearing, a piece of a workpiece with respect to the remainder of the workpiece, punching a hole or stamping a depression or countersink in the workpiece, stamping to form a raised or depressed feature in a workpiece or embossing the workpiece. Preferred workpieces for use with punches the present invention include paper, cardboard, plastic, wood, or metal. Typically, the workpieces are in the form of one or more sheets such as a single sheet of paper or a stack of sheets such as a stack of paper. In a preferred embodiment, punch 1 is configured to punch at least one hole in a sheet of paper or stack of paper sheets.

In the preferred embodiment, punch 1 comprises a punch member with a punch head 3 configured to perform the punching operation. Punch head 3 preferably comprises a punch pin 4. Alternatively, punch member may comprise a die blade or plate with one or more punching elements, such as teeth or serrations, to punch the workpiece. Punch 1 preferably includes a base 6 configured to stably support punch 1 and a support member 8 mounted to and movable with respect to base 6 during a punching operation. Support member 8 is configured to accommodate, locate, and support the workpiece, preferably in a generally upright oriented punching position.

In this embodiment, base 6 includes first and second spaced-apart proximal upstanding portions 10, 12, which are pivotably connected to support member 8 at pivot points 14 and 16, respectively. Preferably, pivot points 14, 16 are aligned along a common pivot axis 18. Therefore, support member 8 is pivotable about common pivot axis 18 with respect to base 6. Support member 8, base 6, and punch head 3 are preferably configured to punch a workpiece upon an actuation motion of support member 8 with respect to base 6.

The actuation motion preferably comprises a pivoting motion of support member 8 with respect to base 6. In the preferred embodiment, a first support member end cap 20 of support member 8 is pivotably connected, such as by pivot pin 22, at pivot point 14 to first proximal upstanding portion 10. Pivot point 14 is preferably coaxial with aperture 24 of first proximal upstanding portion 10, aperture 26 of first support member end cap 20, and pivot pin 22 received therethrough. A second support member end cap 28 is pivotably connected, such as by pivot pin 30, at pivot point 16 to second proximal upstanding portion 12. Pivot point 16 is preferably coaxial with aperture 34 of second proximal upstanding portion 12, aperture 36 of second support member end cap 28, and pivot pin 30 received therethrough.

Figure 4:
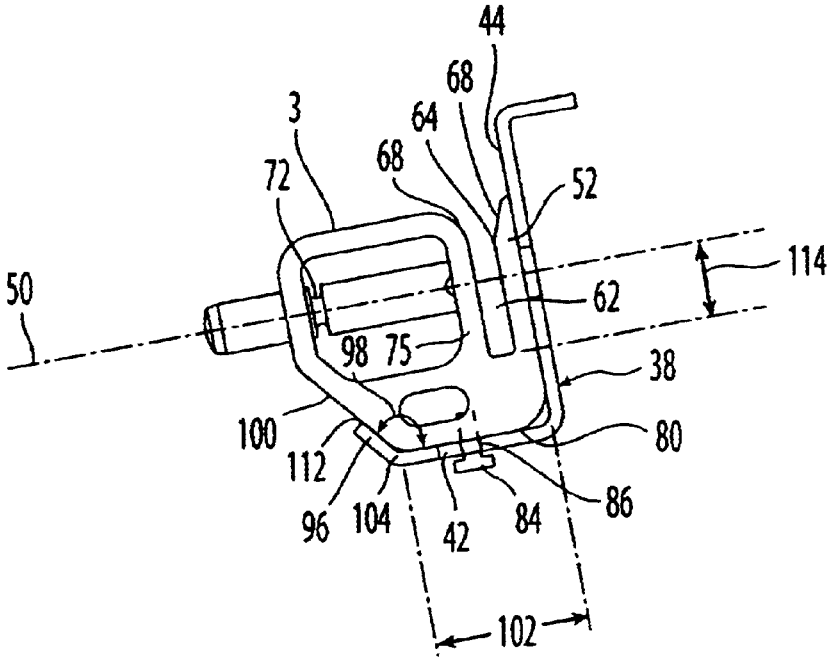
FIG. 4 is a side cross-sectional view of a punch head and a punch cradle of the punch in a punching operable position.

As shown in FIGS. 2–4, support member endcaps 20, 28 are preferably fixed together and configured to pivot in unison with respect to base 6. A punch cradle 38 extends between and connects inner portions of support member endcaps 20, 28, preferably coupling and fixing the endcaps 20, 28. Punch cradle 38 is connected to support member endcaps 20, 28, preferably by a fastener, such as a screw or bolt, or by welding and may be of integral construction with at least one of support member endcaps 20, 28. Typically, punch cradle 38 is constructed of a rigid material such as metal, or the like.

In the preferred embodiment punch cradle 38 includes a lower cradle portion 40 with a slot 42, and an upper cradle portion 44 with a wall configured to securely mount at least one punch head 5. Punch cradle 38 is sufficiently rigid to prevent distortion or significant twisting during punching such that the punch heads 3 are retained in alignment with respect to one another and the workpiece to be punched. The punch 1 shown, allows predetermined hole patterns comprising a plurality of holes to be reproducibly punched in a workpiece.

Figure 5:
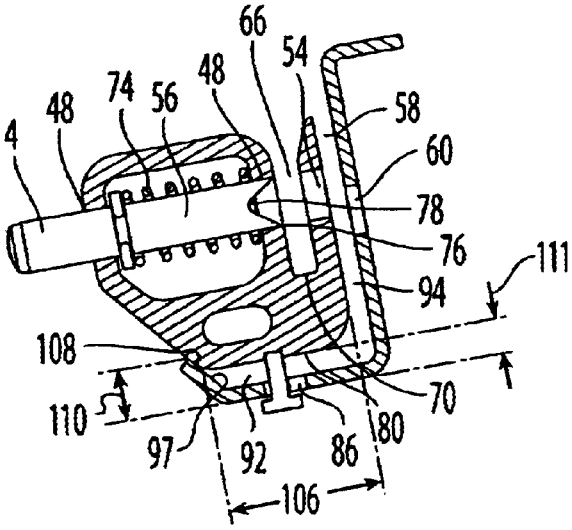
FIG. 5 is a side cross-sectional view of the punch head and the punch cradle shown in a laterally movable association.

As seen in FIGS. 4–5, punch head 3 includes guide holes 48 to slidably retain punch pin 4 along a punch axis 50, which is generally coaxial with the longitudinal axis of punch pin 4. Punch axis 50 is preferably oriented generally at an angle to the horizontal, preferably at least about 0.5°, more preferably at least about 3°. The angle is preferably less than about 60° with respect to the horizontal. In a preferred embodiment, a tongue 52 includes a tongue guide hole 54 preferably aligned with guide holes 48 along the punch axis accommodate a proximal end 56 of punch pin 4 during a punching operation. Upper cradle portion 44, which abuts a tongue outer surface 58 when punch head 3 is secured to cradle 38, preferably includes a discard opening, preferably a laterally extending upper slot 60, to allow proximal end 56 of punch pin 4 to extend through tongue guide hole 54 and to allow a displaced portion of the punched workpiece, such as the portion of the sheet that has been punched out to form the hole, to be discarded through upper cradle portion 44. Alternatively, upper cradle portion 44 may include a plurality of individual discard holes configured and disposed in alignment with tongue guide hole 54. Upper slot 60 is preferably aligned with tongue guide hole 54 when punch head 3 is secured to punch cradle 38, as shown in FIG. 4.

Figure 7:
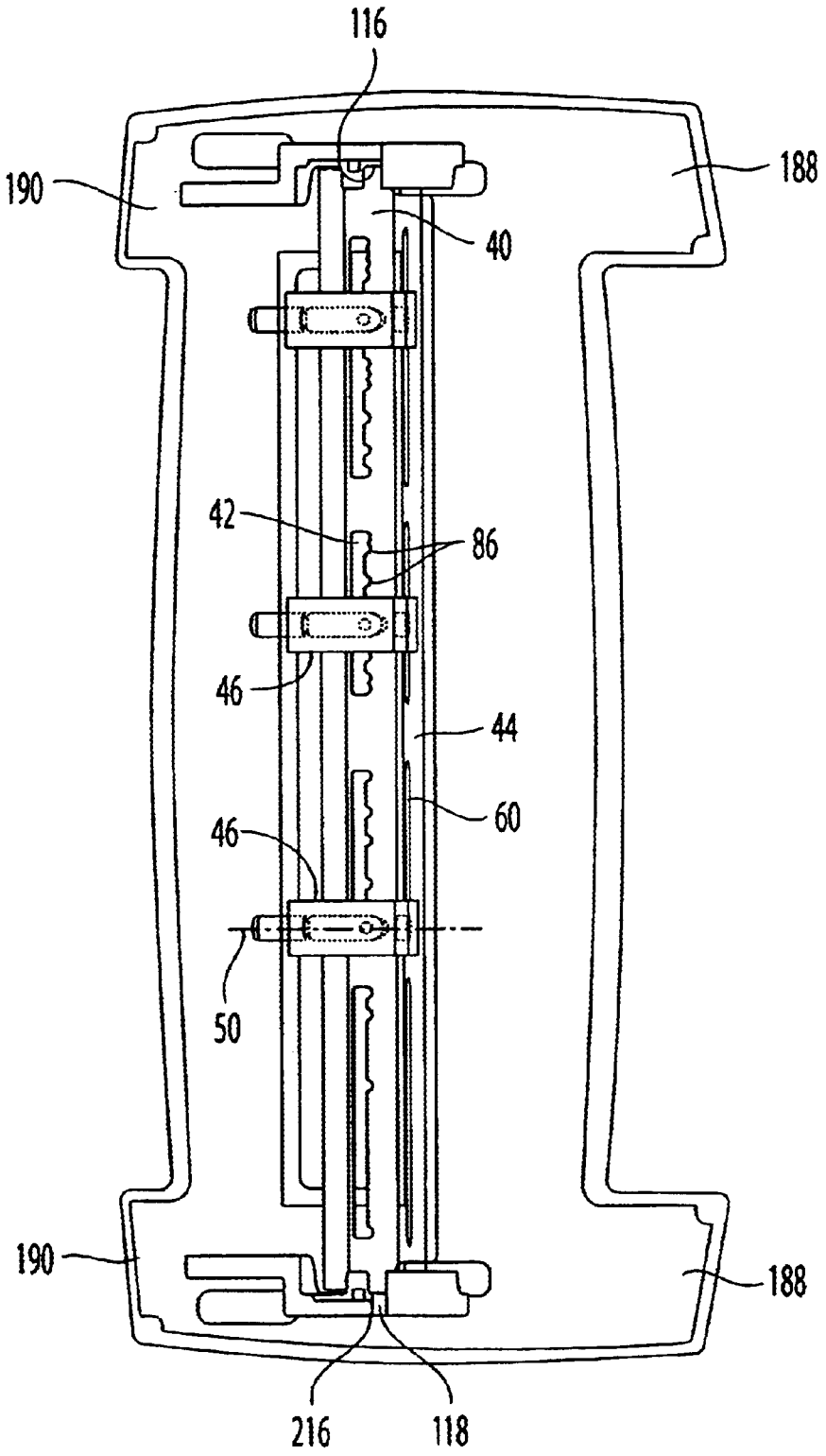
FIG. 7 is a top view showing a base, punch heads and punch cradle of the punch.

Punch head 3 preferably includes a workpiece receiving portion 62 disposed between punch head 3 and an inner tongue surface 64 of tongue 52 and shaped to accommodate and locate a workpiece in a punching position. Receiving portion 62 preferably includes an opening 66 having beveled edges 68 to assist guiding a workpiece into receiving portion 62 and a lower stop 70 to locate and align an edge of a workpiece to prevent further insertion within receiving portion 62. FIGS. 2, 3 and 7 show that openings 66 of receiving portions 62 of punch heads 3 in the punching positions are aligned along a line between first and second support member endcaps 20, 28. In the preferred embodiment, a lower edge of the workpiece is supported and located at least two spaced apart locations. Preferably the lower stops 70 of at least two of the aligned and spaced apart punch heads 3 locate and support the lower edge of the workpiece. Therefore, a workpiece to be punched can be received within the aligned receiving portions 62 to allow a plurality of punching operations to be performed. Tongue 52 and receiving portion 62 are preferably oriented at an angle, for example, a right angle, to punch pin axis 50.

In the preferred embodiment, punch pin 4 is configured to punch holes of preferably standard size, such as round holes about 9/32" in diameter, to allow the punched workpiece to be accommodated by paper sheets binding mechanisms. Punch pin 4 preferably includes a circumferential groove 72, to mount a spring seat, such as a clip washer 73. A spring 74 cooperates with clip washer 73 and a proximal portion 75 of punch head 3 to bias punch pin 4 away from receiving portion 62 to allow a workpiece to be positioned within receiving portion 62, as discussed below. In a preferred embodiment, proximal end 56 of punch pin 4 preferably includes a circumferentially extending cutting edge, such as that disclosed in U.S. Pat. No. 5,730,038 to Evans et al, which is incorporated herein in its entirety. Punch pin 4 preferably has a forward cutting tip 76 and cutting groove 78 configured to punch paper sheets. It should be stressed, however, that punch pin 4 can be configured and shaped to punch holes of other shapes, such as square or rectangular.

Punch heads 3 are preferably securable to punch cradle 38 in a plurality of predetermined punching positions with respect to one another and to the workpiece to allow hole patterns, such as patterns that correspond to preferably standard paper sheets binding mechanisms, to be punched in a workpiece. As seen in FIG. 4, when secured in the punching position, a lower head portion 80 and an outer tongue surface 58 of tongue 52 preferably abut lower and upper cradle portions 40, 44, respectively. Therefore, in the preferred embodiment, lower cradle portion 40 defines a position of punch heads with respect to an axis normal to lower cradle portion 40 and upper cradle portion 44 defines a position of punch heads 3 with respect to a second axis normal to upper cradle portion 44.

Figure 6:
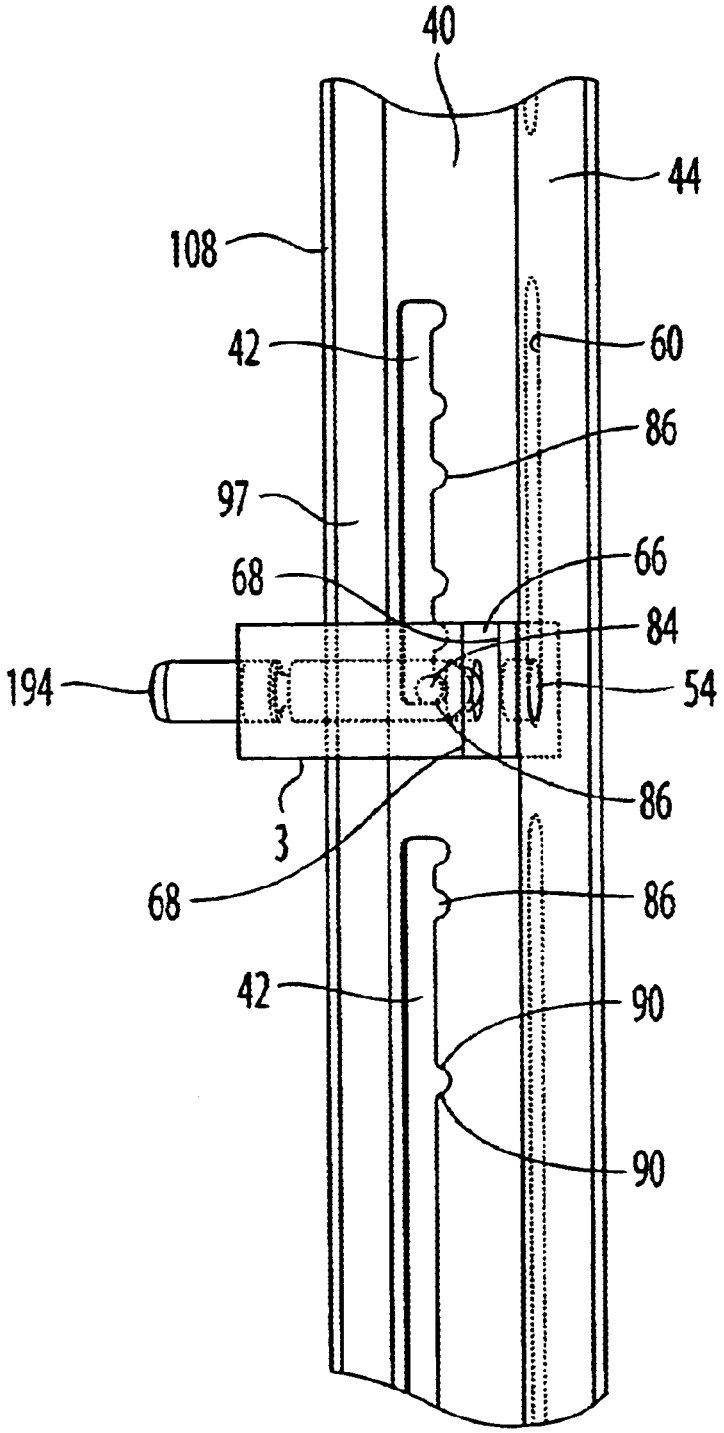
FIG. 6 is a top view showing the punch cradle and punch head of the punching position.

As seen in FIGS. 4 and 6, a fastener, such as a screw 84, is preferably received through a recess 86 adjacent slot 42 in lower cradle portion 40 and threadably engaged with a lower head portion 80 of punch head to secure punch head 3 in the punching position. Recesses 86 are preferably sufficiently wide to receive screw 84 but include lateral stops, such as recess sides 90, which are disposed and configured to prevent substantial lateral movement of punch head 3 upon contacting screw 84 received within recess 86 to maintain the lateral position and alignment of punch head 3. Recesses 86 are preferably disposed to correspond to a plurality of predefined hole patterns, such as standard hole patterns by locating the various punch heads at different combinations of lateral positions along punch cradle 38 to punch proper hole patterns in different sizes of paper.

Alternatively, lower cradle may be configured with a plurality of individual holes instead of repositioning slot 42 with recesses 86 to define predetermined punch positions. Although recesses 86 facilitate aligning more than one punch head 3 in a predefined hole pattern, it should be noted that lower cradle portion 40 may be configured to allow punch head 3 to be secured at any position along punch cradle 38. For example, lower cradle portion 40 may be provided with a slot of generally uniform width.

Punch head 3 and punch cradle 38 are preferably configured such that the punch head 3 is movable from the punching position to a repositioning location in which it is in a laterally movable association with punch cradle 38 to allow the punch head 3 to be repositioned with respect to punch cradle 38. Referring to FIG. 5 with punch head 3 in the laterally positionable association with the cradle 38, a first space 92 is provided between lower punch head portion 80 and lower cradle portion 40 and a second space 94 is provided between outer tongue surface 58 and upper cradle portion 44. In the laterally movable association, screw 84 is displaced from recess 86 and is received within slot 42 to allow punch head 3 to be translated laterally along slot 42 to another punching position with corresponding recess 86. Therefore, the length of screw 84 is selected to allow punch head 3 to be moved from the punching position to the laterally positionable association while at least a portion of screw 84 remains engaged with punch head 3 to prevent screw 84 from becoming separated from punch head 3 while repositioning punch head 3. Upon repositioning punch head 3 to another punching position, screw 84 is preferably securely re-engaged with lower head portion 80 to secure punch head 3 in the new punching position such that screw 84 is received within recess 86 as shown in FIG. 5. Instead of the screw shown, an alternative embodiment has a different type of protrusion receivable in a suitable repositioning slot. Other locating and locking mechanisms may alternatively be employed instead of tightening a screw.

In this embodiment, lower cradle portion 40 and punch head 3 are configured to bias and displace punch head 3 into the punching position from the laterally positionable association when the punch head is locked to the cradle, such as by securely engaging screw 84 with lower punch head portion 80. Referring to FIGS. 4 and 5, punch cradle 38 includes a biasing portion 96 having a biasing surface 97 adjacent lower cradle portion 40 and preferably generally opposed to upper cradle portion 44. Biasing portion 96 and lower cradle portion 40 define an angle 98 there between. Angle 98 is preferably between about 100 and 160 degrees. Punch head 3 includes an angled portion 100 adjacent lower head portion 80 and generally opposed to outer tongue 58. Angled portion 100 and lower head portion 80 are preferably complementary in shape to biasing surface 97 and lower cradle portion 40 and the length 102 between a lower edge 104 of biasing surface 97 and upper cradle portion 44 is substantially identical to the length 106 between a lower edge 108 of angled portion 100 and outer tongue 58. FIG. 5 shows that the height 110 between an upper edge 112 of biasing portion 96 above the height 111 of lower cradle portion 40 is preferably less than first space 92 such that at least a portion of angled portion 100 may abut biasing surface 97 in both the punching position and laterally movable association, as shown in FIGS. 4–5. Therefore, upon securing screw 84, biasing surface 97 and angled portion 100 impart a biasing action to cam the punch head and outer tongue 58 against upper cradle portion 44, while lower head portion 80 is biased against lower cradle portion 40 and towards the discard slot 60, and screw 84 is biased into recess 86 to prevent lateral movement of punch head 3. Alternative cam arrangements can also be employed.

As shown in FIG. 4, a distance 114 between punch pin axis 50 and lower stop 70 preferably determines the distance between a first edge of the workpiece, such as an edge of a sheet of paper received in receiving portion and located adjacent lower stop 70, and the center of a hole formed in the workpiece by punch pin 4. As seen in FIGS. 2 and 7, punch 1 is preferably configured such that an interior surface 116 of first support member end cap 20 locates a second edge of the workpiece, which is typically oriented at a right angle to the first edge of the workpiece. Therefore, the distance between interior surface 116 of first support member end cap 20 and punch pin axes 50 determines the distance between the second edge of the workpiece and the center of a hole formed in the workpiece by punch pin 4. In use, therefore, the first edge of a workpiece positioned for a punching operation, is preferably located by lower stop 70 of receiving portion and the second edge of workpiece is preferably located by interior portion 116 of first support member end cap 20 such that punched holes are reproducibly positioned with respect to both the first and second edges of the workpiece.

Second cradle end cap 28 includes an end cap slot 118 of a height preferably at least as large as the distance between lower stop 70 and opening 66 of receiving portion 62 and preferably aligned with the receiving portions 62 of the punch heads to allow punch to accommodate workpieces having an excess length that is longer than the distance between interior portion 116 of first support member end cap 20 and second support member end cap 28. Therefore, the excess length of the workpiece preferably extends through end cap slot 118.

Punch 1 includes a manually operable and manipulable lever arm 120 with a handle 122 operably associated with support member 8 and configured to impart the actuation motion to support member 8 to punch a workpiece. Lever arm 120 and handle 122 are configured to pivot support member 8 with respect to base 6 upon a pivoting motion of lever arm 120. Alternative arrangements, such as a button, lever, handle, or the like may also be employed to impart the actuation motion. A motor, such as an electrical motor, may be also be used to impart the actuation motion.

In the preferred embodiment, lever arm 120 is pivotably associated with support member 8 to provide a mechanical advantage and reduce the force required to actuate punch 1. To this end, referring back to FIG. 3, punch 1 includes an actuating member 124 pivotably connected to support member 8 at pivot points 126, 128 and configured and disposed to impart an actuation motion to support member 8 upon a pivoting motion of actuating member 124. Pivot points 126, 128 are preferably aligned along a common pivot axis 130 such that actuating member 124 is pivotable with respect to support member 8 about common pivot axis 130. Pivot axis 130 is located opposite one side of a workpiece and handle 122 is located on the other side of the workpiece.

In a preferred embodiment, first and second support member endcaps 20, 28 include first and second distally extending tabs 132, 134, respectively. First tab 132 is preferably pivotably connected, such as by a pivot pin 139, at pivot point 126 to a first actuating member end cap 136. Pivot point 126 is preferably coaxial with apertures 131, 135 and pivot pin 139 received therethrough. Second tab 134 is preferably pivotably connected, such as by a pivot pin 145, at pivot point 128 to a second actuating member end cap 138. Pivot point 128 is preferably aligned with apertures 133, 151 and pivot pin 145 received therethrough.

First and second actuating member endcaps 136, 138 are preferably configured to pivot in unison about common pivot axis 130. A connecting bar 140 extends between and connects first and second actuating endcaps 136, 138, preferably coupling and fixing the endcaps 136, 138. Connecting bar 140 is connected to actuating endcaps 136, 138 by a fastener, such as a screw or bolt, or by welding and may be of integral construction with at least one of the actuating member endcaps 136, 138. Connecting bar 140 includes spaced apart first and second ends 142, 144 that are received within complementary indentations 146, 148 on interior portions 150, 152 of first and second actuating endcaps 136, 138, respectively. To prevent first and second actuating endcaps 136, 138 from pivoting with respect to one another, first and second connecting bar ends 142, 144 and complementary indentations preferably define a non-circular periphery, such as a square shaped periphery.

Actuating arm 120 is preferably fixed to at least one of actuating member endcaps 136, 138 by a fastener, such as a screw or a bolt, or by welding and may be of integral construction with at least one of the actuating endcaps 136, 138. As seen in FIG. 3, first actuating member end cap 136 and actuating arm 120 are fixed together, such as by bolts 107 received through apertures 109 and threadably associated first actuating member end cap 136.

Punch 1 preferably includes a drive member 154 configured and disposed to actuate punch pin 4 upon imparting the actuation motion to support member 8. In the preferred embodiment, actuating member 124 is pivotably associated with drive member 154, to provide a mechanical advantage in the operation of the punch. First actuating member end cap 136 of actuating member 124 is pivotably connected, such as by a pivot pin 141, at pivot point 158 to a first drive member end cap 156. Pivot point 158 is preferably aligned with apertures 137, 155 and pivot pin 141 received therethrough. Second actuating end cap 136 is preferably pivotably connected, such as by a pivot pint 143, at pivot point 162 to a second drive member end cap 160. Pivot point 143 is preferably aligned with apertures 151, 153 and pivot pin 143 received therethrough. Preferably, pivot points 158, 162 are aligned along a common pivot axis 164.

First and second drive member endcaps 156, 160 are preferably fixed together and configured to pivot in unison with respect to actuating member 124 about common pivot axis 164. A drive bar 166 extends between and connects inner portions of drive member endcaps 156, 160, preferably coupling and fixing the endcaps together. Drive bar maybe connected to drive member endcaps 156, 160, preferably by a fastener, such as a screw or a bolt, or by welding and may be of integral construction with at least one of the drive member endcaps 156, 160. Typically, drive bar 166 is constructed to be sufficiently rigid to prevent distortion of drive bar and loss of punching efficiency during a punching operation.

Drive bar 166 includes first and second drive bar ends 150, 152 that are received within complementary indentations 172, 174 on interior portions 158, 160 of drive member endcaps 156, 160. First and second drive bar ends and complementary indentations preferably define a non-circular periphery, such as a substantially rectangular periphery, to prevent first and second drive member endcaps 156, 160 from pivoting with respect to one another.

Figure 8:
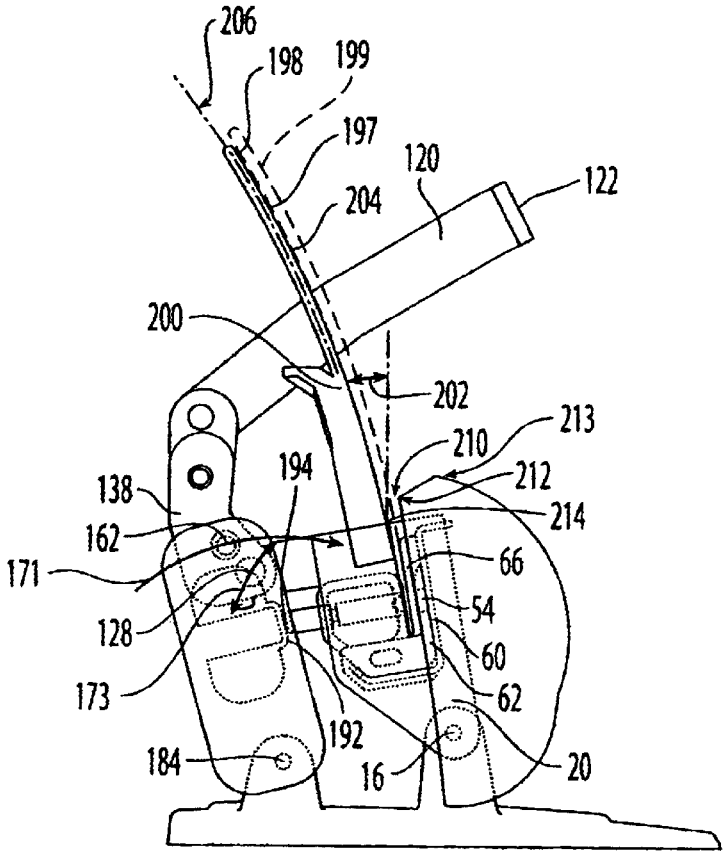
FIG. 8 is a side view of the punch of FIG. 1 but shown the ready position.

A drive surface 192 of drive bar 166 is preferably cammingly associated with the punch pins 4 to perform the punching operation upon imparting the actuation motion to support member 8. As seen in FIG. 8, with punch pin 4 in the ready position, drive surface 192 is disposed distal to and adjacent a distal portion 194 of punch pin 4. Upon pivoting actuating arm 120, drive bar 166 and support member 8 move relatively toward one another such that drive surface 192 abuts distal portion 194 of punch pin 4 in a camming association driving punch pin 4 towards upper cradle portion 44, preferably until punch pin 4 reaches the actuated state shown in FIGS. 5 and 9. In the actuated state, cutting groove 78 and forward cutting tip 76 of punch pin preferably extend across receiving portion 62 and into tongue guide hole 54 and discard hole 60 to shear action the portion of the workpiece to be punched. Although drive surface 192 is generally planar, alternative drive surface geometries, such as a camming drive surface configured with an arcuate surface, may be employed with the present invention.

Base 6 and drive member 154 are preferably pivotably associated. As seen in FIG. 3, first drive member end cap 156 is pivotably connected, such as by a pivot pin 183, at pivot point 180 to a first distal upstanding member 182 of base 6. Pivot point 180 is preferably coaxial with apertures 157, 181 and pivot pin 183 received therethrough. Second drive member end cap 138 is pivotably connected, such as by a pivot pin 177, at pivot point 184 to a second distal upstanding member 178 of base 6. Pivot point 184 is preferably collinear with apertures 159, 179 and pivot pin 177 received therethrough. Preferably, pivot points 180, 184 are aligned along a common pivot axis 186.

Figure 9:
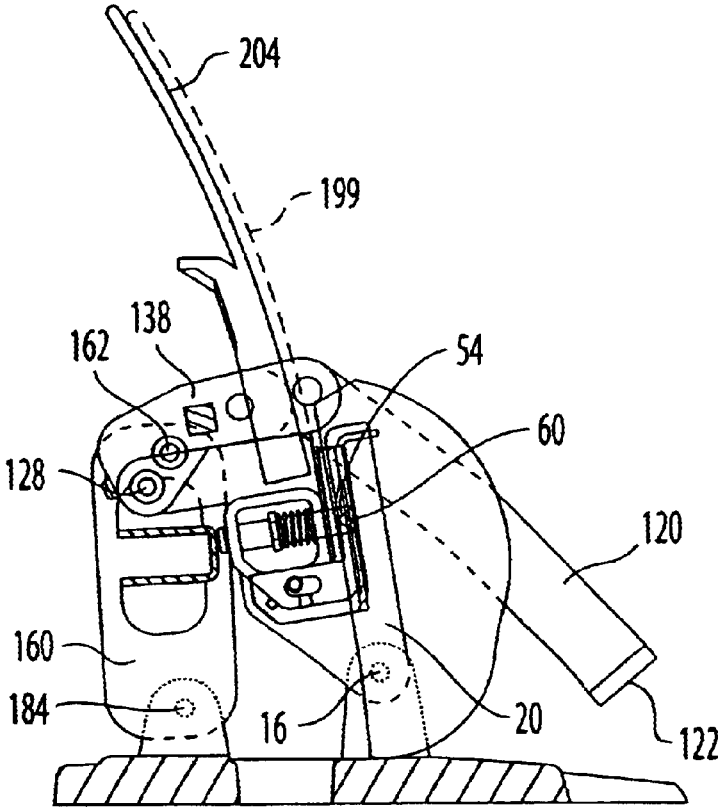
FIG. 9 is a side view of the punch shown in an actuated position.

In the preferred embodiment, base 6, support member 8, actuating member 124, and drive member 154, preferably pivotably connected to form a four-bar linkage to increase stability of the punch and provide a mechanical advantage. As best seen in FIGS. 2, 8 and 9, support member 8 is preferably configured to pivot with respect to base 6 about pivot axis 18. Actuating member 124 and support member 8 are preferably pivotable with respect to one another about pivot axis 130. Actuating member 124 and drive member 154 are preferably pivotable with respect to one another about pivot axis 164. Drive member 154 is preferably pivotable with respect to base 6 about pivot axis 186. Alternatively, however, at least one of the links of the linkage, such as the support member or drive member, may be configured to remain fixed or to translate through a linear path with respect to the base during a punching operation. Additionally, the punch head may be mechanically fixed to another member of the linkage, such that the punch head is movable with respect to the support member and/or workpiece during a punching operation.

The linkage preferably includes first side 10 and second linkage sides 81, 83. The linkage sides are preferably located on opposite sides of the paper tray. The first linkage side 81 includes proximal upstanding portion of base 6, first support member end cap 20, first actuating member 136, first drive member end cap 156, and distal upstanding portion 182 of base 6. The second linkage side 83 includes proximal upstanding portion 12 of base 6, second support member end cap 28, second actuating member 138, second drive member end cap 160, and distal upstanding portion 178 of base 6. Instead of a linkage including a first and second side, an alternative has a linkage including pivot points disposed on only one side of the punch and another embodiment has a linkage with some of its pivots on one side of the punch and paper tray and the other pivots on the opposite side or in another plane. Alternatively, the elements of the first and second linkage sides are of unitary construction. For example, the support member can be formed of end caps and a punch cradle that are formed as a unitary member operating to locate and support the workpiece in a punching position.

The linkage and preferably also the first and second linkage sides 81, 83 are preferably configured and disposed to define respective closed loops. For example, line 196, which connects pivot point 162, to pivot point 184, to pivot point 14, to pivot point 128 of the second side linkage 83, defines a closed loop or quadrilateral comprising two pairs of opposed links. The linkage preferably includes at least one pair of opposed links along the loop that are non-parallel during at least a portion of the punching operation. For example, second drive member end cap 160, which is pivotable about pivot axes 162 and 186 is opposed and non-parallel to second support member end cap 28, which is pivotable about pivot axes 18 and 130. Preferably the pivots are configured such that at least two of the pivots translate along a first plane during actuation of the linkage. Preferably the first plane is disposed at an angle with respect to a lower edge of the workpiece located within the receiving portions 62.

The distance between the two pivot points of one of the members of linkage is preferably substantially shorter than other members of linkage to provide a higher mechanical advantage. In a preferred embodiment, at least one member is substantially shorter than all other members of the linkage. In a more preferred embodiment, the linkage is a crank rocker type linkage and the actuating member 124 includes the shorter link. As best seen in FIG. 2, the distance between pivot point 128 and pivot point 162 of second actuating member end cap 138 is substantially less than a corresponding distance between the two pivot points of any of the other links along the loop to allow actuating member 124 and actuating arm 122 to pivot through a large actuation angle or radial distance, between the ready position shown in FIG. 8 and the actuated position shown in FIG. 9. The actuation angle is generally greater than about 60 degrees and preferably greater than about 75 degrees.

Base 6 is sufficiently long to prevent punch from tipping during a punching operation. Base 6 includes first and second extending portions 188, 190 that increase the length of base 6 preferably such that the handle is always disposed over the base 6 throughout its motion. Thus, the length of the base is preferably greater than the maximum horizontal extent of the handle 122.

In the preferred embodiment, the movable pivot points of the linkage move through arcuate paths during actuation of the linkage to provide a mechanical advantage to a user. As seen in FIG. 8, pivot point 162 and preferably coaxial pivot point 158 move along arcuate line 171 and pivot point 130 and preferably coaxial pivot point 126 move along arcuate line 173 during actuation of the linkage.

Because punch pin 4 travels along the preferably linear punch axis 50 and drive bar 166 preferably travels through an arcuate path parallel to line 171, distal portion 194 of punch pin 4 may slide across drive surface 192 during actuation. Therefore, drive surface 192 and/or pusher portion is preferably configured to reduce friction. Drive surface 192 or distal portion 194 of punch pin 4 may include a hard, stiff material such as hardened steel. A lubricant or coating with lubricating properties including polytetrafluoroethylene or the like may also be used especially if a softer material is used for the drive bar 166. Distal portion 194 of punch pin 4 may also include a bearing, such as a ball bearing, to further reduce friction by providing a rolling engagement with drive surface 192. The drive surface can be arcuate, rather than planar as shown.

Support member 8 stably accommodates and locates a workpiece 199 to be punched to prevent the portion of the workpiece 199 to be punched from moving with respect to punch head 3. In the preferred embodiment, support member 8 includes a paper tray, such as support portion 198, configured to stably support and retain at least a first surface 197 of the workpiece 199 in a punching position. As shown in FIGS. 8–9, support portion 198 is oriented generally upright at an angle to the vertical so that gravity urges the first surface 197 of the workpiece 199 against support surface 198. Lateral portions 200 of support portion 198 define a first angle 202 with respect to the vertical as shown in FIG. 8. The angle 202 is preferably less than about 70 degrees, more preferably less than about 40 degrees, and most preferably has a portion of less than about 25 degrees. An upper portion 204 of support surface of this embodiment defines a curvature 206 as shown FIG. 8. Curvature 206 increases the tendency of gravity to urge the workpiece 199 against support portion 198 by increasing an angle between upper portion 204 and the vertical.

It is not necessary that support portion 198 directly contact a large portion of the first surface 197 of the workpiece. For example, upper support portion 204 may include a support 208 made of a wire or rod, which sufficiently supports portions of a workpiece. It should also be noted that pivots of base 6 associated with upstanding portions 10, 12 in a proximal portion of base 6 are disposed at a greater distance above base 6 than pivots associated with upstanding portions 178, 182 in a distal portion of base 6, which tends further increase angle 202 between support portion 198 and the vertical.

The generally upright configuration of support member 8, also allows gravity to help align the workpiece 199 with respect to the punch head by urging the workpiece against lower stop 70 of receiving portion facilitating single handed operation as the user does not need to hold the paper during punching. Additionally, support member 8 also includes features to facilitate placing the workpiece 199 in a punching position abutting lower stop 70. For example, a gap 210 defined between a lower support portion 214 of support portion 198 and an opposed inward edge 212 of a receiving member 226 is substantially aligned with receiving portion. Gap 210 extends substantially between an edge 216 of end cap slot 118 and first support member end cap 20. Therefore, an edge of the workpiece 199 received through gap is guided into place within receiving portion 62.

Receiving member 226 also includes an inwardly angled portion 218 extending between inward edge 212 and an outward edge 213. Angled portion 218 is configured to guide a workpiece during insertion in the punch toward gap 210 even if the workpiece is out of alignment with gap 210. Often, however, a workpiece will be slightly bowed or arcuate as a user attempts to position the workpiece. For example, if a user grasps an upper central portion of the workpiece, such as a sheet of paper, using a single hand, a flexible workpiece will tend to deform into an arcuate shape. Therefore, as best seen in FIG. 1, support portion includes an arcuate central portion 220 that is concave along two perpendicular directions 222, 224. Arcuate central portion 220 accommodates an arcuately deformed workpiece into gap more readily than a gap defined by two linear edges. Arcuate central portion 220 also serves to stiffen a workpiece with respect to the vertical axis by providing a slight bow or curvature along portions of the workpiece adjacent arcuate central portion. Central arcuate portion 220 preferably ends, however, adjacent lower support portion 214 to facilitate straightening an arcuate workpiece, such that it can be received within receiving portion of punch heads in a generally straight position.

The preferred embodiment is configured such that discarded portions of a punched workpiece, such as paper chips, are visible to an operator upon completion of a punching operation. This allows the operator to visually verify that the punching operation is complete so that the workpiece is not removed prematurely. As mentioned above, during actuation, punch pin 4 travels through guide holes 48 and tongue guide hole 54 toward the discard slots 60 of upper cradle portion 44. As best seen in FIGS. 2 and 9, the displaced portions will be displaced through upper slots 60 in the substantially the same direction as the pivoting motion of the actuating arm toward the front or proximal portion of the punch. Therefore, as best seen in FIG. 2, the discarded portions will be visible to an operator upon pivoting actuating arm.

The discarded portions are preferably received, such as by a container or tray, to facilitate their collection. FIG. 1 shows that receiving member 226 is configured and disposed to receive the discarded portions, which can preferably be disposed of upon removing receiving member 226 from support member 8. Receiving member 226 preferably includes sufficient space to accommodate a plurality of the discarded portions to allow a number of punching operations to be performed between disposing of the discarded portions.

In the preferred embodiment, receiving member 226 is sufficiently transparent to allow an operator to view the discarded portions as they are displaced from punch head and is preferably substantially transparent. Receiving member 226 most preferably comprises sufficiently transparent plastic. Although FIG. 1 shows that receiving member 226 is substantially closed when operably associated with support member 8, an upper portion 209 of receiving member 226 may be provided with an opening sufficient to allow an operator to view the displaced portions therein.

Figure 10:
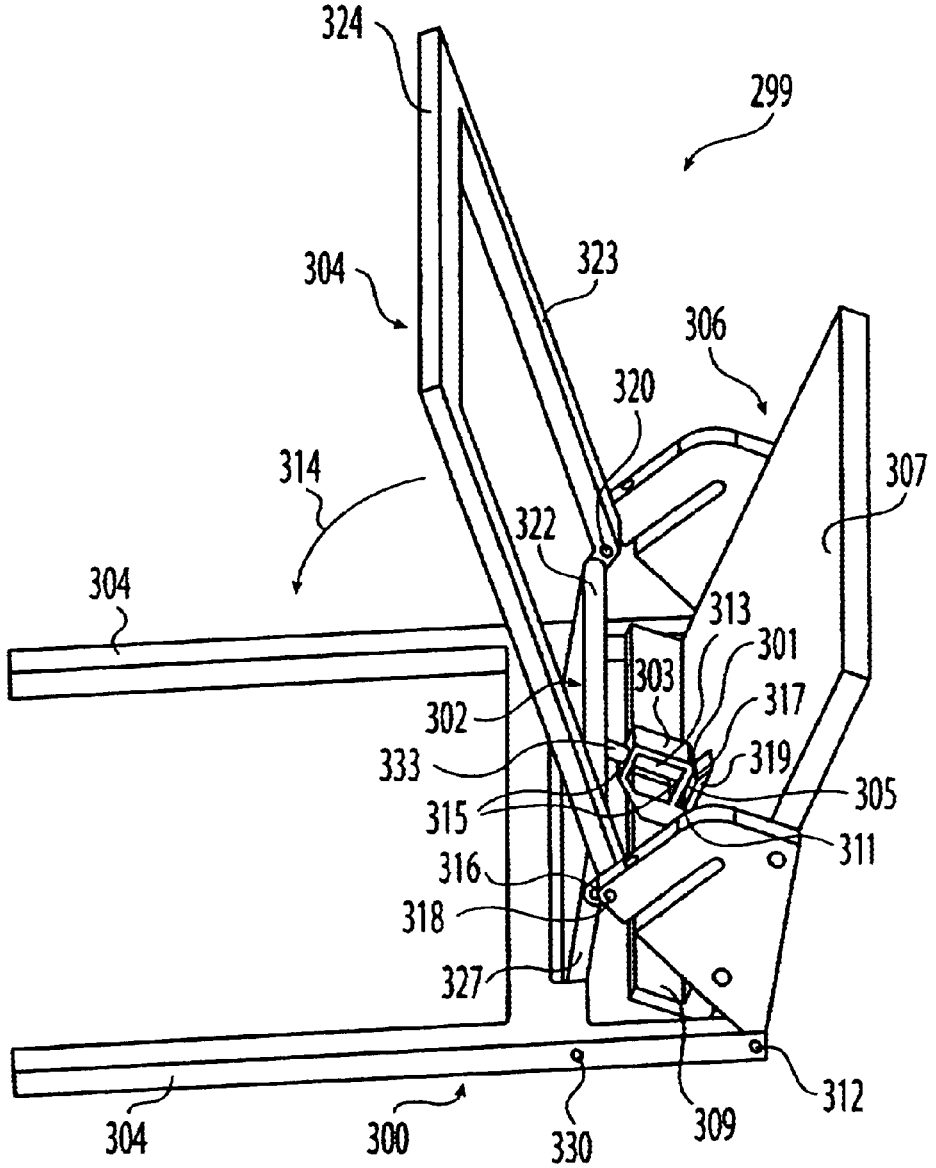
FIG. 10 is a side view of a second embodiment of a punch constructed according to the invention.

As seen in FIG. 10, a second embodiment of a punch 299 includes a base 300 and a support member 306. Support member 306 includes a workpiece support portion, such as a paper tray 307, to support and locate a workpiece for a punching operation. Paper tray 307 preferably supports the workpiece such that substantially all of the workpiece remains visible to a user during punching. Paper tray 307 is preferably oriented upright at an angle.

At least one punch head 303 is preferably disposed proximal to a lower portion 309 of support member to allow gravity to assist locating and positioning the workpiece. Punch head 303 includes an upright receiving portion 305 having an opening 301 and a lower stop 311 to locate the workpiece with respect to a punch pin 313. Punch pin 313 is preferably slidably accommodated along punch head guide holes 315 and a tongue guide hole 317 of a tongue 319. During a punching operation, punch pin 313 is preferably biased toward paper tray 307. Other characteristics of punch pin 313 and punch head 303 are generally similar to the first embodiment described above.

Punch 299 is preferably configured to perform a punching operation upon an actuation motion of support member 306 with respect to base 300. In a preferred embodiment, support member 306 is pivotably connected to base, such as by a pivot pin, at pivot point 312 and a preferably coaxial pivot point on the other side of base 300.

The actuating motion is preferably imparted by an actuating member 304 preferably pivotably connected, such as by a pivot pin, at preferably coaxial pivot points 318, 320 to support member 306. Actuating member preferably includes an actuating arm 323 manually operable and manipulable to impart the actuating motion. In the preferred embodiment, the actuating motion is imparted by pivoting upper portion 324 of actuating arm 323 away from paper tray 307 as shown by line 314. Therefore, during the actuation motion, actuating arm 323 preferably pivots in a generally opposed direction to punch pin 313, which is preferably biased toward support member 306. In this embodiment, actuating arm 323 and pivot points 316, 318 are preferably disposed on the same side of the workpiece as opposed to punch 1 in which the handle 122 and pivot points 158, 162 are preferably disposed on opposed sides of the workpiece.

Base includes proximal extending portions 304 to prevent base 306 from tilting during operation of the punch. Preferably, the actuating arm 323 is always disposed over base 300 throughout its motion. Thus, the length of base 300 with proximal extending portions 304 are preferably greater than the maximum horizontal extent of actuating arm 323.

A drive member 302 comprising a drive plate 327 is preferably pivotably connected, such as by a pivot pin, at preferably coaxial pivot points 316, 322 to actuating member 304. As seen in FIG. 10, base 300, drive member 302, and actuating member 324 are preferably of integral construction. Drive member 302 is preferably pivotably connected, such as by a pivot pin, at a pivot point 330 and a preferably coaxial pivot point on the other side of the punch. Drive plate 327 is preferably cammingly associated with a proximal portion 333 of punch pin 313 to perform a punching operation upon the actuation motion.

Figure 11:
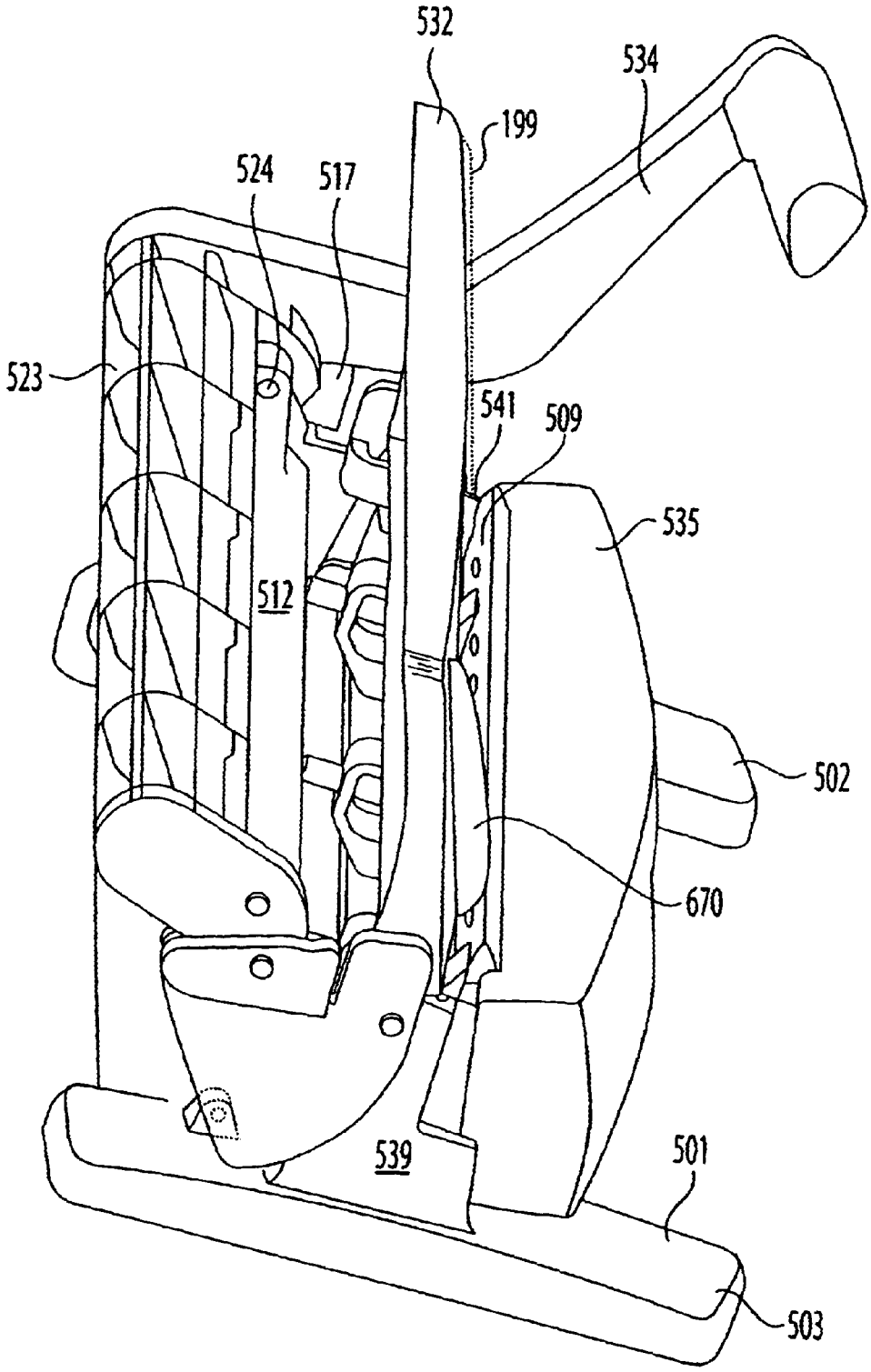
FIG. 11 is a side perspective view of a third embodiment of a punch constructed according to the invention.

Referring to FIG. 11, a third embodiment of a punch 500 includes a support member 509 which remains substantially fixed during a punching operation. Support member 509 preferably extends between upstanding portions 539 and 541 of a base 501. Extending portions of base 501 prevent punch 500 from tilting during operation. Support member 509 operates similarly to support member 8 in facilitating an operator punching a workpiece. For example, support member 509 accommodates the workpiece in a position relative to a punch element such that at least one hole is punched at a desired location in the workpiece upon actuation of the punch. To assist locating the workpiece relative to the punch element, the support member preferably includes at least one surface configured to abut a portion, such as at least one edge, of the workpiece when properly located. Because the workpiece is preferably upright during punching, the support member preferably supports a lower edge of the workpiece when the workpiece is accommodated by the support member.

A support portion 543 comprising a paper tray 532 preferably supports an upper portion of the workpiece 199 in an upright punching position, preferably at a non-zero angle to the vertical. A guide stop 670 of paper tray 532 assists an operator placing a workpiece in a punching position, which is described below. In general, other features of paper tray 532 are similar to those described above for punch 1. Support slots 660 of support portion 509, shown in FIG. 12, receive lower extending portions, not shown, of paper tray 532 to support the paper tray in an upright position.

Figure 12:
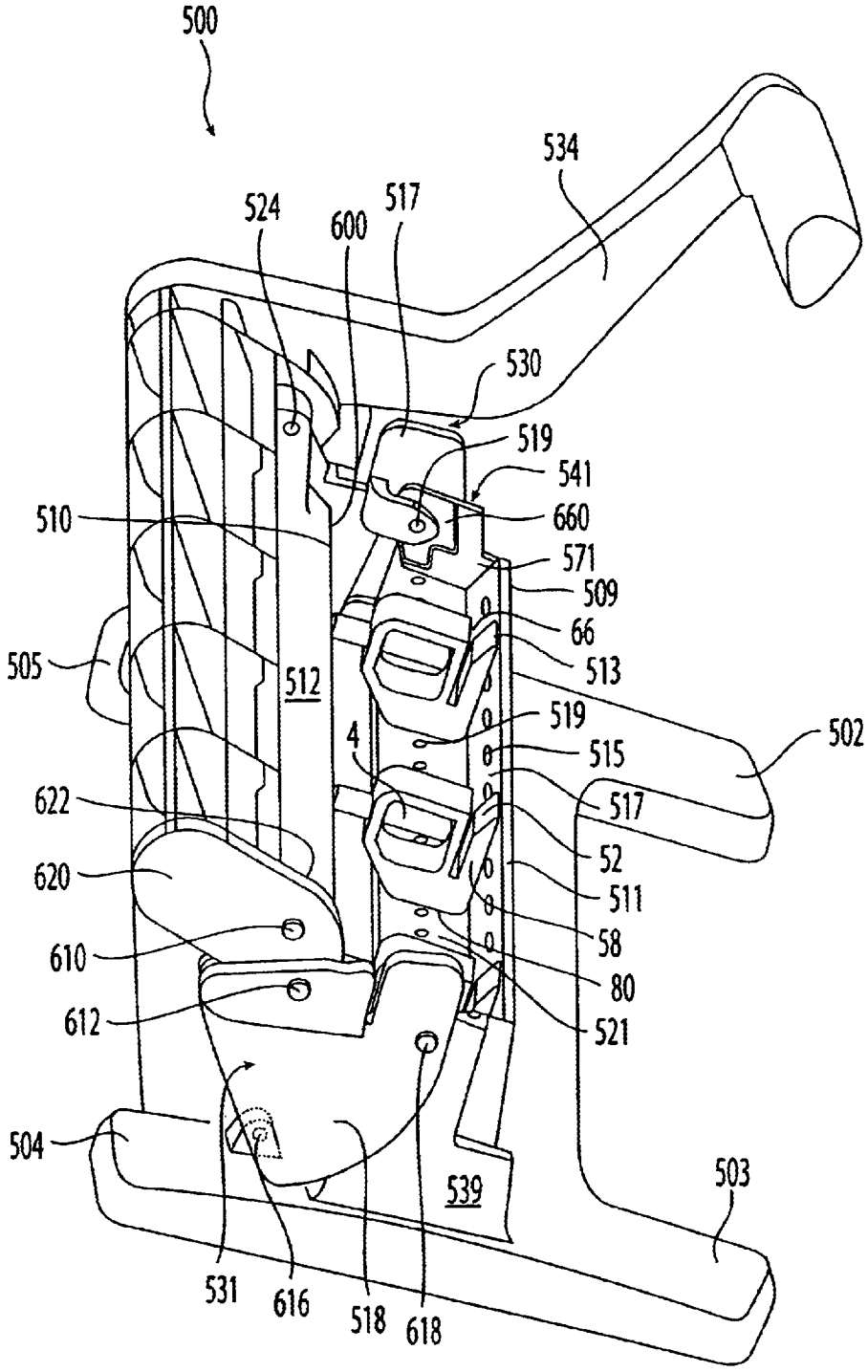
FIG. 12 is a side perspective view of the punch of FIG. 11 with the paper tray and receiving member having been removed.
Figure 13:
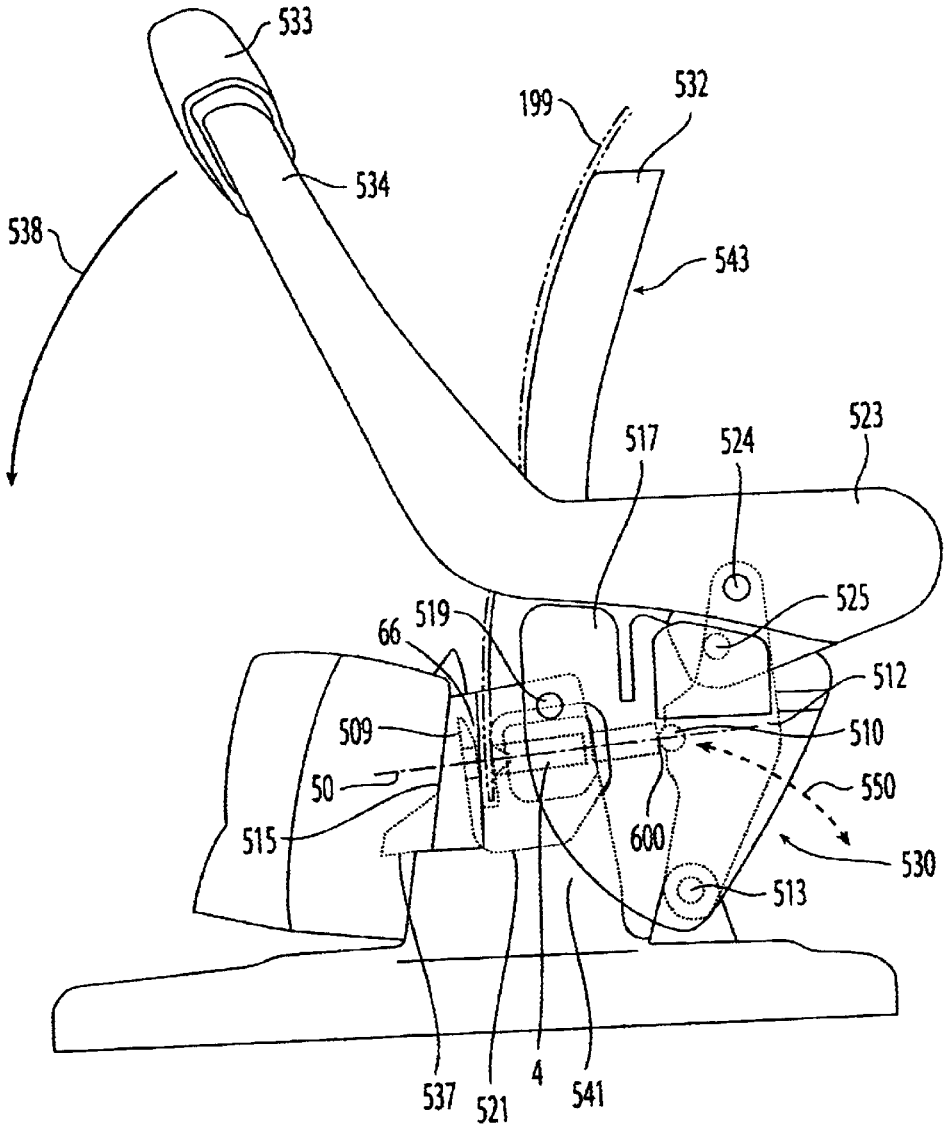
FIG. 13 is a side cross sectional view of the punch of FIG. 11

As best seen in FIGS. 12 and 13, at least one punch head 3 is operably associated with support member 509 to punch a hole in the workpiece. Punch head 3 is preferably securable to a cradle portion 511 of support member 509 at any of a plurality of predetermined punching positions 513 with respect to the workpiece to allow holes to be punched at any location along the workpiece. Referring to FIG. 12, punching positions 513 are defined by discard openings 515 in an upper cradle portion 517. A lower cradle portion 521 includes a plurality of attachment points 519, which are each aligned with a corresponding opening 515. Each punch head 506 is preferably attached to lower cradle portion 521 by means of a fastener, such a screw, not shown. When punch head 3 is secured in the punching position, lower head portion 80 and an outer tongue surface 58 of tongue 52 preferably abut lower and upper cradle portions 521, 517, respectively.

Figure 14:
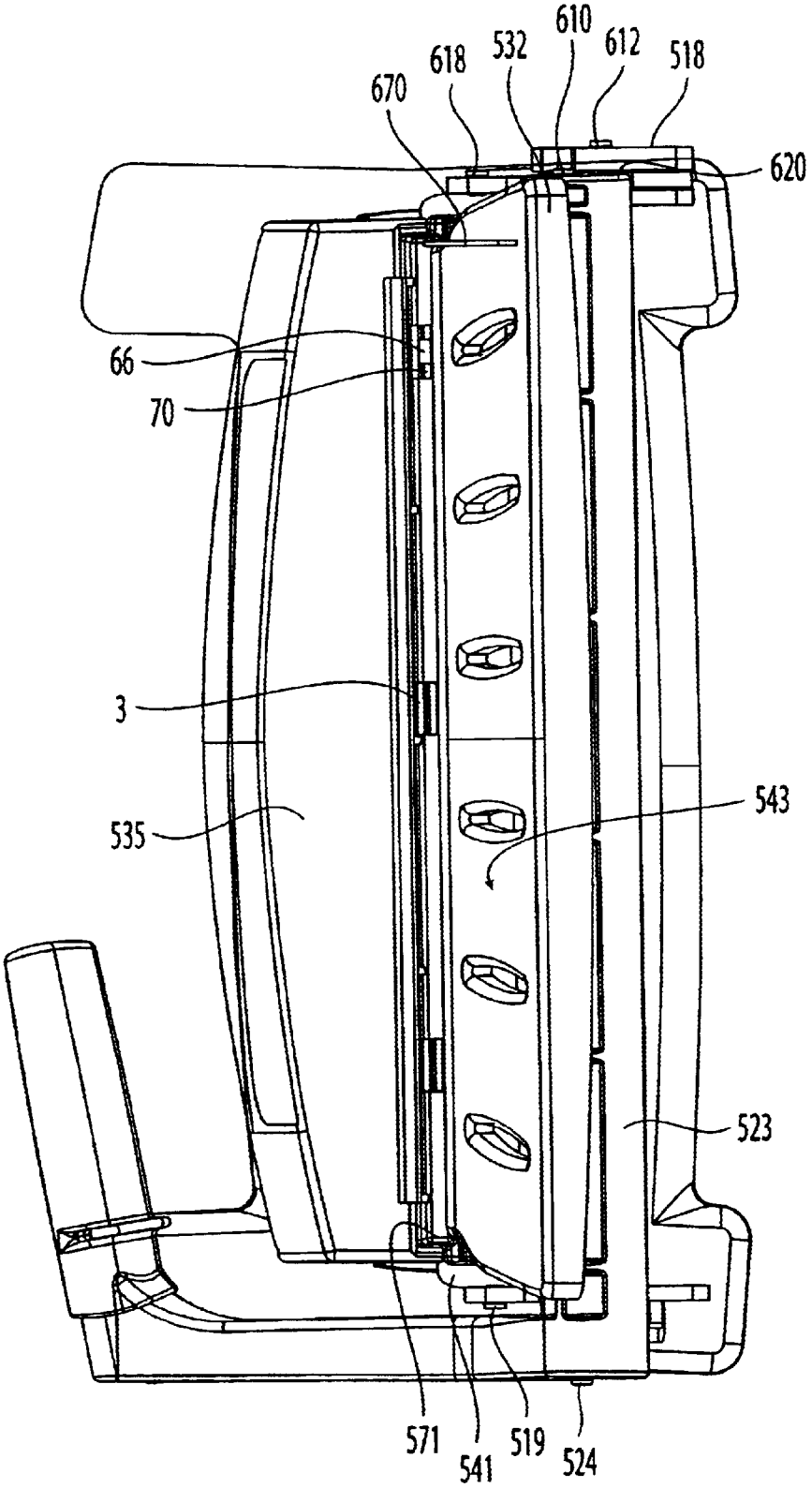
FIG. 14 is a top view of the punch of FIG. 11.

Referring to FIGS. 13 and 14, a workpiece to be punched is preferably supported both laterally and horizontally in a punching position. For clarity, workpiece 199 is omitted from FIG. 14. As described above for punch 1, a bottom 70 of opening 66 of each punch head 3 abuts a lower edge of a workpiece accommodated therein to vertically define a punching position for a workpiece inserted therein. Preferably, support portion 509 supports a workpiece upright to allow gravity to assist in locating the workpiece in a punching position. Guide stop 670 of paper tray 532 cooperates with inner face 571 of upstanding portion 539 to assist a user in laterally locating a workpiece for punching.

Lower cradle portion 521 can alternatively be provided with alignment slots and a biasing member, as discussed above for punch 1. Additional punch heads 3 are provided to facilitate punching patterns of holes. Each punch head 3 preferably includes at least one punch pin 4, as described above.

Punch 500 is preferably configured to perform a punching operation upon an actuation motion of a drive member 512 with respect to support member 509. Referring to FIG. 13, the actuation motion of drive member 512 is preferably along an arcuate path 550 with respect to punch pin axis 50. Drive member 512 is preferably pivotably connected to base 501, such as at a pivot point 513. Upon the actuation motion, a drive surface 600 of drive member 512 moves arcuately, abutting a distal end of punch pin 4 in a preferably camming association driving punch pin 4 along linear punch axis 50 toward a corresponding discard opening 515 to perform the punching operation. The drive surface is preferably an arcuate surface of a push bar 510, such as a metal bar operatively associated with drive member 512. As previously noted, the punch pin or other punch element may be mechanically fixed to another member of the linkage, such as the drive member, such that the pin moves in unison with the other member during a punching operation.

The actuation motion is preferably imparted by an actuation member 523 preferably pivotably connected at a pivot point 524 to drive member 512. Actuating member 523 includes an actuating arm 534 and handle 533, preferably manually operable and manipulable to impart the actuating motion. In the preferred embodiment, the actuating motion is imparted by pivoting actuating arm 534 away from paper tray 532 as shown by line 538.

Punch 500 preferably includes at least one end cap 517 preferably pivotably connected to base 501 at pivot point 519 and to actuating member 523 at pivot point 525. Base 501, actuating member 523, drive member 512 and end cap 517, preferably form a first four-bar linkage side 530 to increase stability of the punch and provide a mechanical advantage. As best seen in FIG. 13, support portion 509 is preferably configured as an upstanding portion of base 501. Actuating member 523 and drive member 512 are preferably pivotable with respect to one another about pivot point 524. Drive member 512 and base 501 are preferably pivotable with respect to one another about pivot point 513. Base 501 and end cap 517 are preferably pivotable with respect to one another about pivot point 519. End cap 517 and actuating member 523 are preferably pivotable with respect to one another about pivot point 525. Upon actuation of the linkage, each of the pivot points of the first four bar linkage side preferably move through arcuate paths within a plane that is disposed at an angle to a plane formed by punch pins 4 secured to support member 509.

To further stabilize the punch during actuation, punch 500 preferably includes a second four bar linkage side 531, which opposes linkage side 530. A lateral end 620 of actuating member 523 is preferably pivotably connected to a lateral end 622 of drive member 512 at a pivot point 610, which is preferably coaxial with pivot point 524. Lateral end 622 of drive member 512 is preferably pivotably connected to base 501 at a pivot point 616, which is preferably coaxial with pivot point 616. Base 501 is preferably pivotably connected with a second end cap 518 at a pivot point 618, which is preferably coaxial with pivot point 519. Second end cap 518 is preferably pivotably connected to lateral end 620 of actuating member 523 at a pivot point 612, which is preferably coaxial with pivot point 525.

Second linkage side 531 preferably moves in unison with linkage 530 upon the actuation motion of actuation member 523. With the exception of end cap 518, the members of second linkage side 531 are preferably unitary or integral with linkage side 530. For example, actuating member 523 preferably extends from first linkage side 530 to second linkage side 531 and is preferably of unitary construction with lateral end 620. With the exception of a support member that is stationary rather than movable, features of the linkages of punch 500, such as the presence of non-parallel sides, are generally similar to those described for punch 1.

During a punching operation, paper chips are preferably expelled through discard openings 515, where they are preferably visible to an operator. The expelled paper chips are collected in generally the same manner as described above for punch 1. Punch 500 comprises a receiving member 535 such as a container or tray associated with base 501. Receiving member 535 is configured, such as being transparent, to allow an operator to view expelled chips therein. The receiving member 535 comprises an insertable chip tray insert 537 for the purposes of deflecting expelled paper chips away from discard openings 515 and into receiving member 535. Receiving member 535 preferably includes a latching member 536, FIG. 11, operatively connecting receiving member 535 to base 501 into the closed position. The receiving member 535 is preferably oriented at a sufficient angle with respect to the base so as to counterbalance the weight of the expelled paper chips and bias the container into the closed position.

One of ordinary skill in the art can envision numerous variations and modifications. All of these modifications are contemplated by the true spirit and scope of the following claims.

What is claimed is:

1. A punch for punching a workpiece, comprising:

a base configured for supporting the punch;

a support member configured to accommodate and locate the workpiece in a generally upright punching position, wherein the support member is movably connected movable with respect to the base during a punching operation; and at least one punch member configured and operably associated with the support member to perform, upon an actuation movement of the support member with respect to the base, a punch operation on the workpiece in the generally upright punching position.

2. The punch of claim 1, wherein the punch comprises a kinematic linkage that includes the base and also a first member that includes the support member.

3. The punch of claim 2, wherein the linkage comprises at least four link members movable with respect to each other and connected together in a closed loop.

4. The punch of claim 3, wherein the linkage further comprises at least four pivots defining therebetween a quadrilateral having at least two opposed, non-parallel sides.

5. The punch of claim 4, wherein the at least two opposed, non-parallel sides comprise first and second pairs of opposed, non-parallel sides.

6. The punch of claim 1, wherein the support member is pivotably connected to the base, and said actuation movement is pivoting with respect to the base.

7. The punch of claim 1, further comprising an actuating portion configured for manual operation and mechanically operatively connected to the support member and punch member for manually imparting said actuation movement.

8. The punch of claim 7, wherein the actuating portion is pivotable through an angle greater than about 60 degrees to actuate the punch.

9. The punch of claim 1, wherein the punch is a paper punch, and the workpiece comprises a stack of paper.

10. A punch for punching at least one sheet of paper, comprising:

a base;

a support portion having a paper tray oriented at a generally upright angle with respect to the base to punchably support a sufficient portion of the sheet of paper to prevent an unsupported portion of the paper from falling over and withdrawing from the support portion; and at least one punch mechanism including an actuating arm driving a drive member that is operably associated with the support portion to punch at least one hole in the sheet of paper upon actuation of the punch, wherein the support portion is movable with respect to the base upon movement of the actuating arm.

11. The punch of claim 10, wherein the punch mechanism includes at least one punch element, wherein, upon actuation of the punch, the punch element travels along a punch axis oriented at a non-zero angle with respect to a horizontal.

12. The punch of claim 11, wherein actuation of the punch produces paper chips and wherein the punch further comprises a container associated with the punch mechanism and configured to receive at least a portion of the paper chips, wherein the container is sufficiently transparent to allow the paper chips to be viewed therethrough.

13. The punch of claim 10, wherein the support portion is oriented at an angle from a vertical to allow gravity to assist positioning a first surface of the sheet of paper against the support portion.

14. The punch of claim 10, wherein at least a portion of the support portion is concave along a horizontal direction.

15. The punch of claim 10, wherein the punch comprises an at least four-member linkage operably associated with the punch mechanism and support portion such that actuation of the linkage actuates the punch.

16. A punch for performing a punching operation upon at least one piece of paper, comprising:

a base;

a support member movable upon actuation of the punch and configured to accommodate and locate the paper in an upright punching position; and at least one punch element configured to punch a hole in the paper upon actuation of the punch, wherein paper chips expelled from the paper are visible to an operator in an operating position to provide confirmation of the punching operation.

17. The punch of claim 16, further comprising a container configured to receive at least a portion of the paper chips.

18. The punch of claim 17, wherein the container is sufficiently transparent to allow the expelled paper chips to be visible in the container.

19. The punch of claim 16, wherein the at least one punch element moves toward the operator upon actuation of the punch.

20. The punch of claim 16, further comprising a container having a deflecting plate to deflect expelled paper chips into the container.

21. The punch of claim 16, wherein the punch element is manually actuated.

22. The punch of claim 1, wherein the support member is oriented at an angle from a vertical, the angle being less than about 40 degrees.

23. The punch of claim 22, wherein the angle is less than about 25 degrees.

24. The punch of claim 13, wherein the angle is less than about 40 degrees from the vertical.

25. The punch of claim 24, wherein the angle is less than about 25 degrees from the vertical.

26. The punch of claim 16, wherein the support member is oriented at an angle from a vertical, the angle being less than about 40 degrees.

27. The punch of claim 26, wherein the angle is less than about 25 degrees from the vertical.

28. The punch of claim 12, wherein the actuating arm is configured to be operated from a side of the punch that includes the container.

29. The punch of claim 17, further comprising an actuating member configured to be operated by the operator from a side of the punch that includes the container.

* * * * *

UNITED STATES PATENT AND TRADEMARK OFFICE

CERTIFICATE OF CORRECTION

PATENT NO. : 6,688,199 B2
DATED : February 10, 2004
INVENTOR(S) : Jon Godston et al.

It is certified that error appears in the above-identified patent and that said Letters Patent is hereby corrected as shown below:

Column 16,
Line 40, delete “movably connected”.

Column 17,
Line 41, delete “and support portion”.

Signed and Sealed this

Twenty-fifth Day of May, 2004

JON W. DUDAS
*Acting Director of the United States Patent and Trademark Office*